US005416059A

United States Patent [19]

Tsuda et al.

[11] Patent Number: 5,416,059

[45] Date of Patent: May 16, 1995

[54] HEAT TRANSFER IMAGE-RECEIVING SHEET

[75] Inventors: Kenji Tsuda; Kiyomaro Mihara; Kozo Odamura, all of Tokyo, Japan

[73] Assignee: Dai Nippon Printing Co., Ltd., Japan

[21] Appl. No.: 257,771

[22] Filed: Jun. 9, 1994

[30] Foreign Application Priority Data

Jun. 10, 1993 [JP] Japan ..... 5-163843

[51] Int. Cl.[6] ..... B41M 5/035; B41M 5/38

[52] U.S. Cl. ..... 503/227; 428/195; 428/212; 428/913; 428/914

[58] Field of Search ..... 8/471; 428/195, 212, 428/913, 914; 503/227

[56] References Cited

U.S. PATENT DOCUMENTS 4,971,950 11/1990 Kato et al. ..... 503/227

FOREIGN PATENT DOCUMENTS 0348157 12/1989 European Pat. Off. ..... 503/227
0409597 1/1991 European Pat. Off. ..... 503/227
2-38089 2/1990 Japan ..... 503/227

*Primary Examiner*—B. Hamilton Hess
*Attorney, Agent, or Firm*—Parkhurst, Wendel & Rossi

[57] ABSTRACT

There is provided a heat transfer image-receiving sheet comprising a substrate sheet and a dye-receptive layer, the substrate sheet comprising a core substrate; a first resin layer formed on one surface of the core substrate, on which layer the dye-receptive layer is formed; and a second resin layer formed on the other surface of the core substrate, the difference in the degree of heat shrinkage between the first resin layer and the second resin layer being in the range of 0.4% to 2.0%.

8 Claims, 3 Drawing Sheets

HEAT TRANSFER IMAGE-RECEIVING SHEET

BACKGROUND OF THE INVENTION

1. Field of the Invention

This invention relates to a heat transfer image-receiving sheet, and more particularly to a heat transfer image-receiving sheet which can remarkably reduce troubles during conveyance thereof in a printer.

2. Background Art

Heretofore, a heat transfer sheet comprising a substrate sheet and a dye layer has been used when the output printing of a computer or a word processor is conducted by a sublimation-type heat transfer printing method. This heat transfer sheet has a substrate sheet which is heat resistant, and a dye layer which is formed on the substrate sheet in such a manner that an ink prepared by mixing a sublimable dye and a binder is coated onto the substrate sheet and then dried. When heat is applied to the back surface of the heat transfer sheet by a thermal head, a large number of color dots of three or four colors are transferred to an image-receiving sheet. A multicolored image is thus produced on the image-receiving sheet. Since a dye is used in the heat transfer sheet as a coloring agent, the image produced is very sharp and clear. In addition, a half-tone image with good gradation can be obtained with high reproducibility. Thus, a high quality image comparable to a multicolored photographic image can be obtained.

The above mentioned image-receiving sheet generally comprises a substrate sheet and a dye-receptive layer. An image-receiving sheet has recently been employed which has a substrate sheet composed of an ordinary paper and a resin film laminated on the paper. Such an image-receiving sheet, whose substrate sheet is composed of paper and a resin which are completely different in the degree of heat shrinkage from each other, is very likely to curl. There is often a case where an image-receiving sheet is already curled to a considerable degree when it is placed in the sheet-feed section of a printer. In this case, the image-receiving sheet is likely to cause troubles while it is conveyed in a printer, which makes it difficult to stably receive an image on the sheet.

It is therefore an object of the present invention to provide a heat transfer image-receiving sheet which scarcely causes troubles due to curling while it is conveyed in a printer, and on which a high quality image can be stably produced.

SUMMARY OF THE INVENTION

The above object can be attained, according to the present invention, by a heat transfer image-receiving sheet which comprises a substrate sheet and a dye-receptive layer, the substrate sheet comprising a core substrate, a first resin layer formed on one surface of the core substrate, on which layer the dye-receptive layer is formed, and a second resin layer formed on the other surface of the core substrate, the difference in the degree of heat shrinkage between the first resin layer and the second resin layer being in the range of 0.4% to 2.0%.

The heat transfer image-receiving sheet according to the present invention, when it is placed in the paper-feed section of a printer only shows a certain small degree, acceptable level of curling. What is more, the small curling occurs always in a constant direction. The heat transfer image-receiving sheet of the present invention, when applied to a printer properly selected among the types, causes very few troubles during conveyance thereof in the printer, as will be described in more detail hereinbelow.

DETAILED DESCRIPTION OF THE INVENTION

The present invention will be explained in detail by referring to the accompanying drawings.

Figure 1:
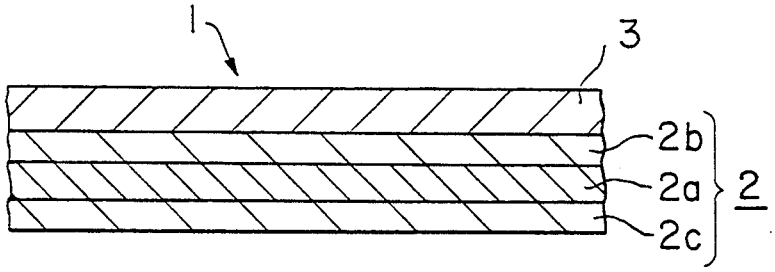
FIG. 1 is a diagrammatic cross-sectional view of a heat transfer image-receiving sheet according to the present invention.

FIG. 1 is a diagrammatic cross-sectional view of a heat transfer image-receiving sheet according to the present invention. As shown in the figure, the heat transfer image-receiving sheet 1 has a substrate sheet 2, and a dye-receptive layer 3 formed on one surface of the substrate sheet 2.

The substrate sheet 2 is composed of a core substrate *2a*, a first resin layer *2b* formed on one surface of the core substrate *2a*, and a second resin layer *2c* formed on the other surface of the core substrate *2a*. The dye-receptive layer 3 is formed on the first resin layer *2b*.

Any material which has been used for the substrate sheet of conventional heat transfer image-receiving sheets can be used for the core substrate *2a*. Examples of the material include various types of papers such as polyolefin synthetic paper, polystyrene synthetic paper, high quality paper, art paper, coated paper, cast coated paper, wall paper, backing paper, paper impregnated with a synthetic resin, paper impregnated with an emulsion, paper impregnated with a synthetic rubber latex, paper internally added with a synthetic resin and cardboard; cellulose fiber paper; films of various plastics such as polyolefin, polyvinyl chloride, polyethylene terephthalate, polystyrene, polymethacrylate and polycarbonate; and laminates thereof. Particularly preferred are lightweight coated paper having a basis weight of 60 to 80 $g/m^2$, and a biaxially oriented polyethylene terephthalate resin film having a thickness of 50 to 70 $\mu m$. In particular, a biaxially oriented polyethylene terephthalate resin film containing white fine particles of titanium oxide, barium sulfate or the like can be preferably used.

Any resin which has been used for the substrate sheet of conventional heat transfer image-receiving sheets can be used for the first resin layer *2b* and the second resin layer 2c. Examples of the resin include polyolefin, polyvinyl chloride, polyethylene terephthalate, polystyrene, polymethacrylate and polycarbonate. In particular, a biaxially oriented polypropylene resin film containing minute voids, having a density of 0.50 to 0.70 g/cm$^3$ and a thickness of approximately 30 to 60 μm, or synthetic paper laminated with a polypropylene resin containing inorganic fine particles such as of calcium carbonate, titanium oxide or silica, having a basis weight of 40 to 60 g/m$^2$ and a thickness of approximately 50 to 70 μm is preferably used.

The thickness of the substrate sheet 2 may be properly determined depending upon the strength and the like required. However, the thickness of the core substrate 2a is generally about 30 to 200 μm, preferably about 50 to 80 μm; the thickness of the first resin layer 2b is generally about 30 to 100 μm, preferably about 30 to 70 μm; the thickness of the second resin layer 2c is generally about 30 to 100 μm, preferably about 30 to 70 μm; and the total thickness of the substrate sheet 2 is generally about 90 to 400 μm, preferably about 110 to 220 μm.

The dye-receptive layer 3 is provided to receive a sublimable dye transferred from a heat transfer sheet, and to retain an image produced thereon.

Examples of a resin to be used for forming the dye-receptive layer 3 include polyolefin resins such as polypropylene, halogenated polymers such as polyvinyl chloride and polyvinylidene chloride, vinyl polymers such as polyvinyl acetate and polyacrylate, polyester resins such as polyethylene terephthalate and polybutylene terephthalate, polystyrene resins, polyamide resins, copolymers of an olefin such as ethylene or propylene with other vinyl monomer, aionomers, cellulose resins such as cellulose diacetate, and polycarbonate. Of these resins, vinyl resins and polyester resins are particularly preferred.

According to the present invention, the difference between the degree of heat shrinkage S1 of the first resin layer 2b and the degree of heat shrinkage S2 of the second resin layer 2c should be adjusted within the range of 0.4% to 2.0%. The degree of heat shrinkage is herein determined in the following manner: a sample having dimensions of 12 cm×12 cm is prepared, and two marks are put on the sample in the longer direction at an interval of 100 mm. The sample is allowed to stand horizontally at 120° C. for 5 minutes, and then cooled in the air to room temperature. The distance L between the marks is then measured. The degree of heat shrinkage S can be determined by the following equation:

$$S(\%) = \frac{|L(\text{mm}) - 100(\text{mm})|}{100(\text{mm})} \times 100$$

The above specified difference between the degrees of heat shrinkage of the first and the second resin layers of the substrate sheet, according to the present invention, has been established based on the following findings by the present inventors.

Figure 2:
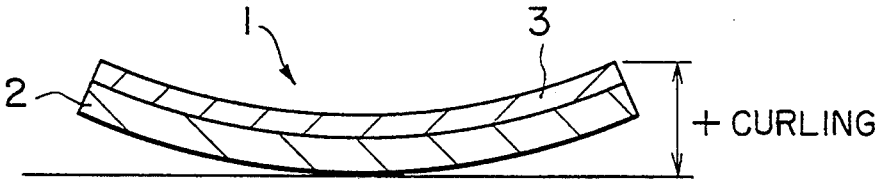
FIG. 2 is an illustration showing the state of "+curling" in a heat transfer image-receiving sheet.
Figure 3:
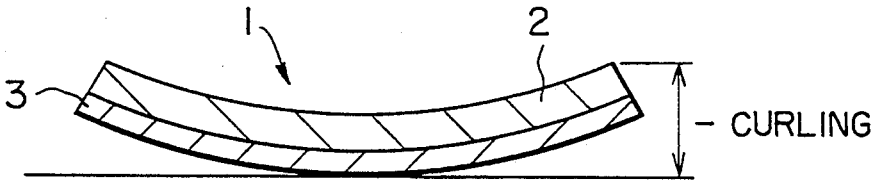
FIG. 3 is an illustration showing the state of "−curling" in a heat transfer image-receiving sheet.

Curling in a heat transfer image-receiving sheet can be classified into two types: Curling in which a dye-receptive layer 3 is concave as shown in FIG. 2 (hereinafter called "+curling"); and curling in which a substrate sheet 2 is concave as shown in FIG. 3 (hereinafter called "−curling").

Figure 4:
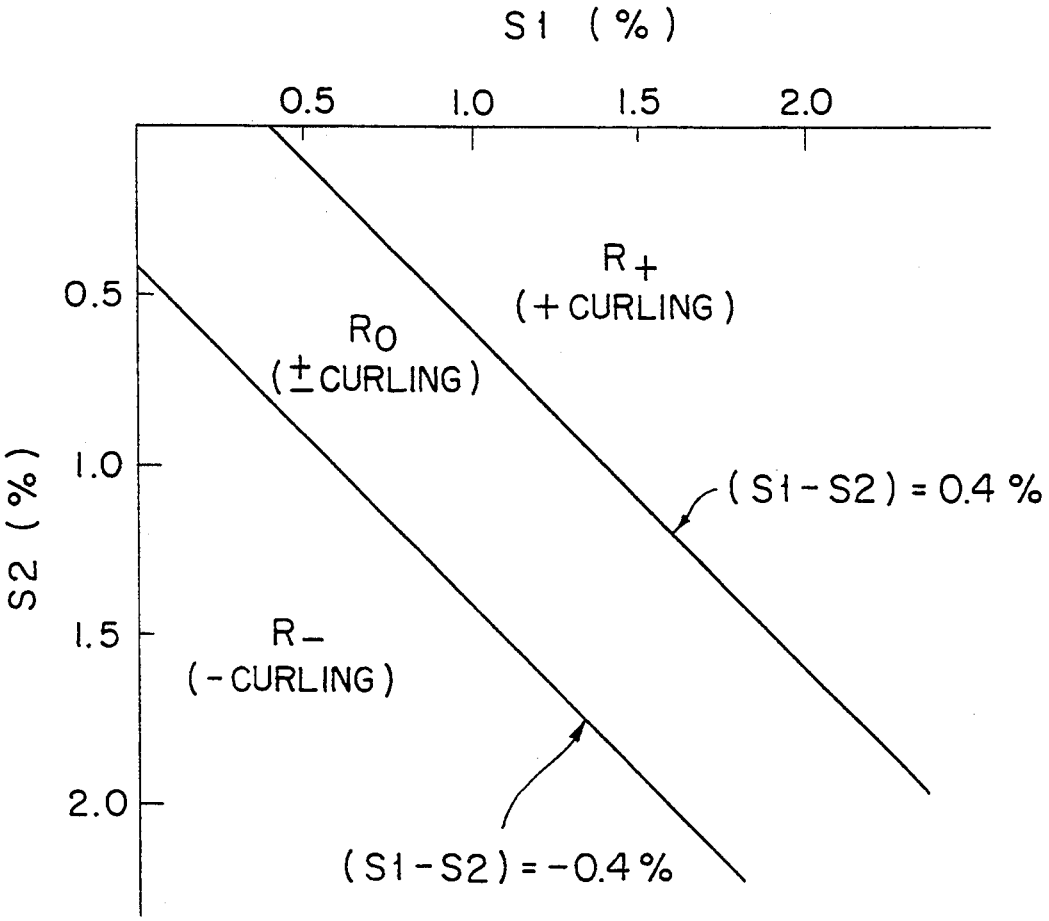
FIG. 4 is a graph showing the correlation between the occurrence of curling in a heat transfer image-receiving sheet of the present invention and the degree of heat shrinkage of the first and second resin layers.

The present inventors found at first that the degree of curling in a heat transfer image-receiving sheet is not so high and within an acceptable level when the difference between the degrees of heat shrinkage (S1−S2) is in the range of −2.0% to 2.0%. The inventors further found that, as shown in FIG. 4, when the difference (S1−S2) is in the $R_+$ region which is above the straight line of (S1−S2)=0.4%, the "+curling" generally occurs in a heat transfer image-receiving sheet; when the difference (S1−S2) is in the $R_-$ region which is below the straight line of (S1−S2)=0.4%, the "−curling" occurs; and when the difference (S1−S2) is in the region $R_0$ which is between the straight lines of (S1−S2)=0.4% and (S1−S2)=−0.4%, it is uncertain as to which curling ("+curling" or "−curling") occurs.

In general, the sheet-feed section of a printer has a mechanism which works to deliver heat transfer image-receiving sheets from a tray into the machine by a sheet-feed roll. There are two types in the manner for delivering sheets one sheet after another at the sheet-feed section: One type is such that sheets are delivered from the upper most sheet of a stack of sheets, and the other type is such that sheets are delivered from the lower most sheet of a stack of sheets. In either type, there are a case where a sheet is delivered from a tray with the dye-receptive layer upward, and a case where a sheet is delivered from a tray with the dye-receptive layer downward, depending upon the position of a thermal head in the image-transfer section of a printer. It is, of course, most preferable that heat transfer image-receiving sheets be not curled at all when they are set in a sheet-feed tray. When a heat transfer image-receiving sheet is curled, it has been found that a sheet curled with its concavity toward the bottom of a tray causes far fewer troubles during conveyance thereof in a printer as compared with a sheet curled in the contrary direction.

For this reason, for a printer in which heat transfer image-receiving sheets are to be set in a sheet-feed tray with the dye-receptive layer downward, it is preferable to use those heat transfer image-receiving sheets in which "+curling" is surely to occur. Thus, the difference between the degrees of heat shrinkage (S1−S2) is made to 0.4% to 2.0% (in the R+ region in FIG. 4) in the first embodiment of the heat transfer image-receiving sheet of the present invention.

On the other hand, for a printer in which heat transfer image-receiving sheets are to be set in a sheet-feed tray with the dye-receptive layer upward, it is preferable to use those heat transfer image-receiving sheets in which the "−curling" is surely to occur. Thus, the difference between the degrees of heat shrinkage (S1−S2) is made to −2.0% to −0.4% (in the R− region in FIG. 4) in the second embodiment of the heat transfer image-receiving sheet of the present invention.

Further, there are two types in the mechanism of the image-transfer section of a printer: In one type, heat transfer image-receiving sheets pass between a thermal head and a platen roll in a linear manner without traveling around the platen roll (see FIG. 5), and in another type, the sheets pass between a thermal head and a platen roll while they travel around the platen roll to the extent of approximately $\frac{1}{4}$–$\frac{3}{4}$ of the circumference thereof (see FIG. 6). In the image-transfer section, heat transfer image-receiving sheets tend to be curled because of heat shrinkage due to heat applied from the thermal head, leading to troubles in the sheet-discharge section of a printer. In the former type, the "+curling" in which the dye-receptive layer side is concave (the curling as shown in FIG. 2) is likely to occur. For such a printer, it is preferable to use a heat transfer image-receiving sheet according to the above-described second embodiment of the present invention so that the occurrence of "+curling" can be suppressed. In the case of the latter type, heat transfer image-receiving sheets travel around a hot platen roll, so that the "−curling" in which the substrate sheet side is concave (the curling as shown in FIG. 3) is likely to occurs. For such a printer, it is preferable to use a heat transfer image-receiving sheet according to the above-described first embodiment of the present invention so that the occurrence of "−curling" can be suppressed.

The heat transfer image-receiving sheet of the present invention may further comprise an intermediate layer between the substrate sheet 2 and the dye-receptive layer 3. Such an intermediate layer is provided so as to enhance the adhesion between the substrate sheet 2 and the dye-receptive layer 3, and may be formed of a polyurethane, acrylic, polyethylene, polypropylene or epoxy resin. It is preferred that the thickness of the intermediate layer be approximately 0.1 to 25 μm.

Further, a foam-containing layer may also be provided between the substrate sheet 2 and the above-described intermediate layer. Such a foam-containing layer may be formed by using a foaming agent. Examples of the foaming agent include decomposable foaming agents, such as dinitropentamethylenetetramine, diazoaminobenzene, azobisisobutyronitrile and azodicarbonamide, which are decomposed by heat to generate gas such as oxygen, carbon dioxide or nitrogen; and microballoons which are prepared by microencapsulating low-boiling liquid such as butane or pentane with a resin such as polyvinylidene chloride or polyacrylonitrile.

Furthermore, an antistatic agent may be added to the dye-receptive layer 3. Examples of the antistatic agent include known antistatic agents, for instance, cationic antistatic agents such as a quaternary ammonium salt and a polyamine derivative, anionic antistatic agents such as an alkyl phosphate, and nonionic antistatic agents such as a fatty ester.

The present invention will now be explained more specifically by referring to the following examples, which should not be construed as limiting the present invention.

EXAMPLE 1

Coated paper ("New Top", manufactured by Kanzaki Paper Mfg. Co., Ltd., basis weight: 72.3 g/m$^2$, thickness: 60 μm) was used as the core substrate of a substrate sheet. On the both surfaces of this core substrate, foamed polypropylene sheets (manufactured by Toyobo Co., Ltd., thickness: 60 μm) having various degrees of heat shrinkage were laminated as the first and second resin layers by the use of an adhesion, whereby 17 types of substrate sheets were prepared. The degrees of heat shrinkage of the first and second resin layers of each substrate sheet, determined by the above-described method, are shown in Table 1.

Next, a coating liquid for forming a dye-receptive layer having the following formulation was coated (amount of coating=5.0 g/m$^2$ (dry basis)) onto the surface of the first resin layer of the substrate sheet by using a bar coater, and dried first with a drier and then in an oven adjusted to 100° C. for 30 minutes to form a dye-receptive layer.

| <Formulation of Coating Liquid for Dye-Receptive Layer> | |
|---|---|
| Vinyl chloride-vinyl acetate copolymer resin ("1000A", manufactured by Denki Kagaku Kogyo K.K.) | 20 parts by weight |
| Amino-modified silicone ("KF-393", manufactured by Shin-Etsu Chemical Co., Ltd.) | 3 parts by weight |
| Epoxy-modified silicone ("X22-393", manufactured by Shin-Etsu Chemical Co., Ltd.) | 3 parts by weight |
| Methyl ethyl ketone | 37 parts by weight |
| Toluene | 37 parts by weight |

Next, a coating liquid for forming a slip layer having the following formulation was coated (amount of coating=1.0 g/m$^2$ (dry basis)) onto the surface of the second resin layer of the substrate sheet by using a bar coater, and then dried to form a slip layer. Heat transfer image-receiving sheets (samples 1 to 17) having dimensions of 150 mm×150 mm were thus obtained.

| <Formulation of Coating Liquid for Slip Layer> | |
|---|---|
| Acrylic resin ("BR-85", manufactured by Mitsubishi Rayon Co., Ltd.) | 15.0 parts by weight |
| Filler ("Orgasol", manufactured by Nihon Rirusan Co., Ltd.) | 0.1 part by weight |
| Cationic antistatic agent ("TB-128", manufactured by Matsumoto Yushi-Seiyaku Co., Ltd.) | 0.1 part by weight |
| Methyl ethyl ketone/toluene (weight ratio = 2:1) | 89.8 parts by weight |

The above-obtained heat transfer image-receiving sheets (samples 1 to 17) were allowed to stand at 100° C. for one minute, and at 40° C. and 90% relative humidity for 48 hours, respectively. Thereafter, the degree of curling occurred in each heat transfer image-receiving sheet was determined by the following method: A sheet was placed on a platen, and the distance between the platen and the highest point of the sheet was determined as the degree of curling. The results are shown in Table 1. In Table 1, "+" and "−" indicate the above-defined "+curling" and "−curling", respectively.

Figure 5:
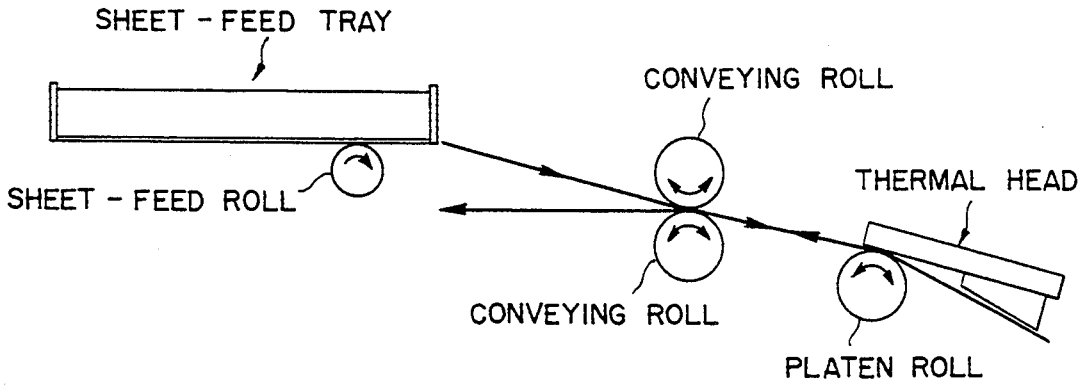
FIG. 5 is an illustration showing how a heat transfer image-receiving sheet is fed and conveyed in Printer A which was used in the printing test carried out in Examples 1 and 2.
Figure 6:
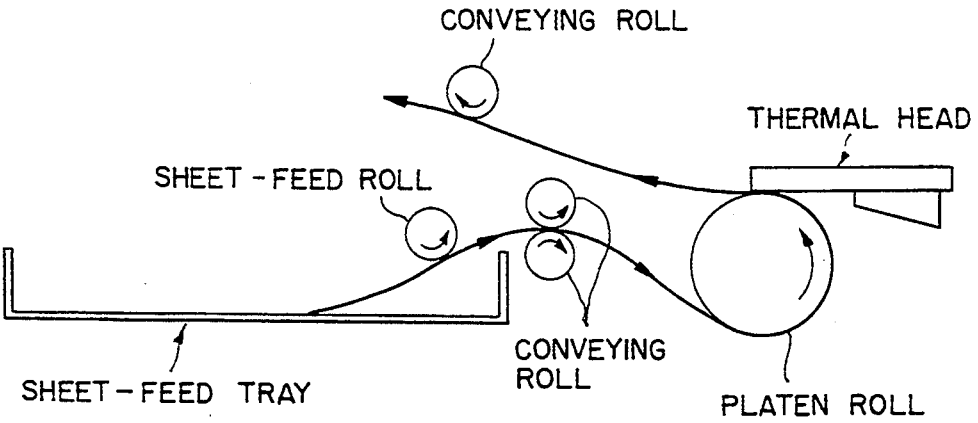
FIG. 6 is an illustration showing how a heat transfer image-receiving sheet is fed and conveyed in Printer B which was used in the printing test carried out in Examples 1 and 2.

Further, in order to examine suitability of each heat transfer image-receiving sheet for conveyance in a printer, printing was conducted (a black-colored solid image was continuously printed on 50 sheets) by using two types of printers (Printer A and Printer B) as shown in FIGS. 5 and 6.

In printer A, the heat transfer image-receiving sheets were set in the sheet-feed tray with the dye-receptive layer upward, and fed one sheet after another from the lower most sheet of a stack of the sheets from the lower part of the tray. On the other hand, in Printer B, the heat transfer image-receiving sheets were set in the sheet-feed tray with the dye-receptive layer downward, and fed one sheet from another from the upper most sheet of a stack of the sheet from the upper part of the tray.

In each of the samples 1, 5, 6, 10 and 11, "+curling" was visually observed for some sheets (of 50 sheets) and "−curling" for the other sheets when they were set in the sheet-feed tray of each of the printers. As regards the other samples, on the other hand, all of 50 sheets were curled in a constant direction.

The results of the printing test are shown in Table 1. In Table 1, "○" indicates that no trouble (failure in conveyance of a sheet in a printer) occurred during the 50-sheet printing, and "X" indicates that one or more sheets could not be conveyed in the printer.

TABLE 1

| Sample No. | Degree of heat shrinkage of the first and second resin layers (%): First resin layer $S_1$ | Second resin layer $S_2$ | $(S_1 - S_2)$ | Degree of curling (mm): 100° C. 1 minute | 40° C. 90% 48 hours | Suitability for conveyance: Printer (A) | Printer (B) |
|---|---|---|---|---|---|---|---|
| 1 | 0.5 | 0.5 | 0 | +2 | −5 | X | X |
| 2 | 1.4 | 0.5 | +0.9 | +24 | +16 | X | O |
| 3 | 1.4 | 0.9 | +0.5 | +7 | +5 | X | O |
| 4 | 1.3 | 0.9 | +0.4 | +3 | +2 | X | O |
| 5 | 1.4 | 1.3 | +0.1 | −3 | +1 | X | X |
| 6 | 1.3 | 1.4 | −0.1 | −1 | +2 | X | X |
| 7 | 0.9 | 1.3 | −0.4 | −4 | −2 | O | X |
| 8 | 0.9 | 1.4 | −0.5 | −4 | −3 | O | X |
| 9 | 0.4 | 1.2 | −0.8 | −15 | −8 | O | X |
| 10 | 0.75 | 0.4 | +0.35 | +6 | +1 | X | X |
| 11 | 0.4 | 0.75 | −0.35 | −3 | −1 | X | X |
| 12 | 2.8 | 0.3 | +2.5 | +45 | +39 | X | X |
| 13 | 2.8 | 1.0 | +1.8 | +27 | +21 | X | O |
| 14 | 4.8 | 2.8 | +2.0 | +26 | +23 | X | O |
| 15 | 0.3 | 2.8 | −2.5 | −52 | −53 | X | X |
| 16 | 1.0 | 2.8 | −1.8 | −19 | −25 | O | X |
| 17 | 2.8 | 4.8 | −2.0 | −22 | −23 | O | X |

EXAMPLE 2

A polyethylene terephthalate film having a thickness of 75 μm ("Lumirror", manufactured by Toray Industries, Ltd.) was used as a core substrate. Polypropylene synthetic papers ("Yupo", manufactured by Oji-Yuke Synthetic Paper Co., Ltd.) having various degrees of heat shrinkage were laminated on the both surfaces of the core substrate by the use of an adhesive, whereby 7 types of substrate sheets were prepared. The degrees of heat shrinkage of the synthetic papers used as the first and second resin layers of each substrate sheet, determined by the above-described method, are shown in Table 2.

A dye-receptive layer and a slip layer were formed on each substrate sheet in the same manner as in Example 1, whereby heat transfer image-receiving sheets (samples 18 to 24) having dimensions of 150 mm×150 mm were obtained.

For the thus obtained heat transfer image-receiving sheets, the measurement of the degree of curling and the printing test were conducted in the same manner as in Example 1. In the printing test, it was visually observed that both of "+curling" sheets and "−curling" sheets were present in the sheet-feed tray of the printer in the case of sample No. 19, whereas in the other samples all of the respective 50 sheets were curled in a constant direction. The results are shown in Table 2.

TABLE 2

| Sample No. | Degree of heat shrinkage of the first and second resin layers (%): First resin layer $S_1$ | Second resin layer $S_2$ | $(S_1 - S_2)$ | Degree of curling (mm): 100° C. 1 minute | 40° C. 90% 48 hours | Suitability for conveyance: Printer (A) | Printer (B) |
|---|---|---|---|---|---|---|---|
| 18 | 0.3 | 1.1 | −0.8 | −6 | −5 | O | X |
| 19 | 1.3 | 1.2 | +0.1 | +1 | −1 | X | X |
| 20 | 1.1 | 0.3 | +0.8 | +8 | +6 | X | O |
| 21 | 0.3 | 2.6 | −2.3 | −30 | −33 | X | X |
| 22 | 1.5 | 2.6 | −1.1 | −20 | −19 | O | X |
| 23 | 2.6 | 0.3 | +2.3 | +32 | +31 | X | X |
| 24 | 2.6 | 1.5 | +1.1 | +22 | +23 | X | O |

What is claimed is:

1. A heat transfer image-receiving sheet comprising:

a substrate sheet comprising a core substrate, a first resin layer formed on one surface of the core substrate, and a second resin layer formed on the other surface of the core substrate, wherein a difference in the degree of heat shrinkage between the first resin layer and the second resin layer ranges from 0.4% to 2.0%; and a dye-receptive layer formed on the first resin layer.

2. The heat transfer image-receiving sheet according to claim 1, further comprising an intermediate layer between the substrate sheet and the dye-receptive layer.

3. The heat transfer image-receiving sheet according to claim 1, wherein the degree of heat shrinkage of the first resin layer is higher than that of the second resin layer.

4. A method for reducing trouble during conveyance of a heat transfer image-receiving sheet in a printer wherein sheets are to be set in a sheet-feed tray of the printer with the dye-receptive layer of the sheets downward, which comprises feeding to the printer the heat transfer image-receiving sheet according to claim 3.

5. The method according to claim 4, wherein the printer has a thermal head and a platen roll, and the sheets pass between the thermal head and the platen roll while they travel around the platen roll to the extent of approximately $\frac{1}{4}$–$\frac{3}{4}$ of the circumference thereof.

6. The heat transfer image-receiving sheet according to claim 1, wherein the degree of heat shrinkage of the first resin layer is lower than that of the second resin layer.

7. A method for reducing trouble during conveyance of a heat transfer image-receiving sheet in a printer wherein sheets are to be set in a sheet-feed tray of the printer with the dye-receptive layer of the sheets upward, which comprises feeding to the printer the heat transfer image-receiving sheet according to claim 6.

8. The method according to claim 7, wherein the printer has a thermal head and a platen roll, and the sheets pass between the thermal head and the platen roll in a linear manner without travelling around the platen roll.

* * * * *